US012061064B2

(12) United States Patent
Malheiros et al.

(10) Patent No.: US 12,061,064 B2
(45) Date of Patent: Aug. 13, 2024

(54) AIRGUN WITH SELECTIVE BYPASS FROM HIGH PRESSURE RESERVOIR TO FIRING PRESSURE RESERVOIR

(71) Applicant: Crosman Corporation, Bloomfield, NY (US)

(72) Inventors: George Wallace Rodrigues Malheiros, Victor, NY (US); Anthony Thomas Cioppa, Rochester, NY (US)

(73) Assignee: CROSMAN CORPORATION, Bloomfield, NY (US)

( * ) Notice: Subject to any disclaimer, the term of this patent is extended or adjusted under 35 U.S.C. 154(b) by 0 days.

(21) Appl. No.: 18/115,424

(22) Filed: Feb. 28, 2023

(65) Prior Publication Data

US 2024/0077276 A1 Mar. 7, 2024

Related U.S. Application Data

(63) Continuation of application No. 17/466,335, filed on Sep. 3, 2021, now Pat. No. 11,592,260, which is a continuation of application No. 16/458,990, filed on Jul. 1, 2019, now Pat. No. 11,112,207, which is a continuation of application No. 15/796,279, filed on Oct. 27, 2017, now Pat. No. 10,337,824.

(60) Provisional application No. 62/414,419, filed on Oct. 28, 2016.

(51) Int. Cl.
*F41B 11/723* (2013.01)
*F41B 11/62* (2013.01)

(52) U.S. Cl.
CPC ..... *F41B 11/723* (2013.01); *F41B 11/62* (2013.01)

(58) Field of Classification Search
CPC ..... F41B 11/72; F41B 11/721; F41B 11/722; F41B 11/723
See application file for complete search history.

(56) References Cited

U.S. PATENT DOCUMENTS

| | | | | |
|---|---|---|---|---|
| 3,631,555 | A * | 1/1972 | Hurst | F28G 1/12 15/104.062 |
| 4,403,421 | A | 9/1983 | Shepherd | |
| 4,484,370 | A * | 11/1984 | Easley, Jr. | B01J 8/003 15/104.062 |
| 4,951,644 | A | 8/1990 | Bon | |
| 5,224,465 | A | 7/1993 | Milliman | |
| 5,370,033 | A | 12/1994 | Bitsakis et al. | |
| 6,003,504 | A * | 12/1999 | Rice | F41B 11/722 124/75 |
| 6,216,351 | B1 | 4/2001 | Flubacher et al. | |

(Continued)

FOREIGN PATENT DOCUMENTS

GB 2160299 A 12/1985

*Primary Examiner* — Bret Hayes
(74) *Attorney, Agent, or Firm* — Brian B. Shaw, Esq.; Harter Secrest & Emery LLP

(57) ABSTRACT

An airgun has a high pressure reservoir for providing a pressurized motive gas to a breech to fire a projectile. A regulator is intermediate the high pressure reservoir and a downstream firing pressure reservoir for providing a consistent regulated pressure of the motive gas in the firing pressure reservoir. The airgun includes a bypass line for selectively connecting the high pressure reservoir to the firing pressure reservoir, independently of the regulator. Thus, an operator can select a firing of the airgun with either a regulated gas pressure in the firing reservoir or the pressure of the high pressure reservoir.

11 Claims, 7 Drawing Sheets

(56) References Cited

U.S. PATENT DOCUMENTS

| | | | | |
|---|---|---|---|---|
| 6,807,959 | B1 | 10/2004 | Murdock et al. | |
| 7,069,922 | B1 | 7/2006 | Orr | |
| 7,770,612 | B1 * | 8/2010 | Brown | B60P 7/065 141/10 |
| 10,337,824 | B2 | 7/2019 | Malheiros et al. | |
| 2002/0046747 | A1 * | 4/2002 | Colby | F41B 11/724 124/73 |
| 2003/0168052 | A1 * | 9/2003 | Masse | F41B 11/57 124/73 |
| 2003/0230296 | A1 | 12/2003 | Farrell | |
| 2004/0154600 | A1 | 8/2004 | Jong | |
| 2005/0126553 | A1 | 6/2005 | Rice | |
| 2006/0005824 | A1 | 1/2006 | Carpenter | |
| 2006/0236586 | A1 | 10/2006 | Zaderey | |
| 2007/0157915 | A1 | 7/2007 | Benetti et al. | |
| 2007/0175465 | A1 | 8/2007 | Quinn et al. | |
| 2008/0105245 | A1 | 5/2008 | Cole | |
| 2009/0159065 | A1 | 6/2009 | Moffitt | |
| 2011/0314721 | A1 | 12/2011 | Lamb | |
| 2014/0026877 | A1 | 1/2014 | Grundy et al. | |
| 2014/0373424 | A1 | 12/2014 | Silvers et al. | |
| 2016/0153741 | A1 | 6/2016 | Axelsson | |

* cited by examiner

AIRGUN WITH SELECTIVE BYPASS FROM HIGH PRESSURE RESERVOIR TO FIRING PRESSURE RESERVOIR

CROSS-REFERENCE TO RELATED APPLICATIONS

This application is a continuation of U.S. patent application Ser. No. 17/466,335 filed Sep. 3, 2021, now U.S. Pat. No. 11,592,260, which is a continuation of U.S. patent application Ser. No. 16/458,990 filed Jul. 1, 2019, now U.S. Pat. No. 11,112,207, which is a continuation of U.S. patent application Ser. No. 15/796,279 filed Oct. 27, 2017, now U.S. Pat. No. 10,337,824, which claims the benefit of priority to U.S. Provisional Patent Application Ser. No. 62/414,419, filed on Oct. 28, 2016, the content of each of which is relied upon and hereby incorporated herein by reference in its entirety.

STATEMENT REGARDING FEDERALLY SPONSORED RESEARCH OR DEVELOPMENT

Not applicable.

REFERENCE TO A "SEQUENCE LISTING"

Not applicable.

BACKGROUND OF THE INVENTION

Field of the Invention

The present disclosure relates to firing projectiles from a gun and more particularly to the firing of projectiles from an airgun, wherein the airgun selectively exposes a firing pressure reservoir to one of a regulated pressure of a motive gas or a high pressure reservoir of the motive gas.

Description of Related Art

The use of a compressed gas, such as air, to fire projectiles is well known. The guns using such compressed gas are often referred to as airguns. Airguns can be generally classified in three major categories as relating to the source of power: (i) pump guns, (ii) spring guns and (iii) pre-charged or pre-charged pneumatic (PCP) guns.

The first category, pump guns, use one or more strokes from a pumping device to store a charge of compressed air. The required effort to charge the gun increases with each pump as the stored pressure builds. Because the relatively low mechanical advantage of the pumping mechanism, the power of the gun depends on the strength of the shooter. These guns completely expel the air charge when fired. On firing, the pellet is initially exposed to the full pressure of the compressed air, but the available pressure falls rapidly as the pellet accelerates down the gun barrel thereby increasing the volume into which the compressed air can expand.

The second category, spring guns use a single stroke of a lever to compress a mechanical spring. On firing, the spring drives a relatively heavy piston that causes a rapid increase in air pressure within a firing chamber. The pellet is held in the gun barrel by a seal until the air pressure in the firing chamber reaches an optimum point. When this happens, the air pressure overcomes the holding ability of the seal and drives the pellet down the barrel. The piston also continues to displace air into the firing chamber, thereby helping to maintain pressure on the pellet. Only one stroke of the lever accomplishes the entire cocking procedure. Thus, a spring gun usually takes less time to charge than a multi-stroke gun. However, the drawback of a spring gun is that only one stroke of the lever is available to compress the spring. The most powerful spring guns require strength beyond the limit of many people. Moreover, the spring imposes a practical limit on the amount of energy that can be stored. The mechanical spring can include a compressed air "spring." The compressed air in the "spring" is not expended but is re-compressed with the gun's lever. The air spring can store more energy in a smaller space, but considerable work must be expended by the user to compress the spring.

The third category, pre-charged pneumatic (PCP) guns, use a gas charge that is pre-packaged and inserted into the gun. One type of this use a small container of liquid carbon dioxide $CO_2$ to power the gun. These containers typically retain approximately 12 grams of compressed $CO_2$. Each firing of the gun uses a portion of the stored liquid, which rapidly vaporizes on firing. In an alternative configuration of the PCP guns, the guns use compressed air transfer from a high pressure storage bottle into an on board high pressure storage vessel attached to the gun. For example, air from a scuba tank or similar pressure container is transferred into the on board storage vessel on the gun through a high-pressure hose and clamp assembly. While the gun gets multiple shots from charges provided by the air in the on board storage vessel, the accuracy of the gun diminishes with the loss of available pressure until the storage vessel is refilled. While these guns are moderately powerful, they also suffer from accuracy problems with the loss of available pressure in the container. Guns which use compressed air from large detached tanks can store more energy and suffer less in accuracy loss between shots. However, the detached tank (such as a scuba tank) is heavy and cumbersome. Further, the higher performing PCP guns in terms of projectile energy are limited to single digit number of shots.

Thus, PCP air rifles are known for their power and accuracy, wherein the rifles are typically design for hunting or competition. Competition PCP air guns use a pressure regulator to reduce the variation on pressure and hence reduce the variation of pellet velocity so to improve the accuracy. However, there is a trade off when a regulator is added into the rifle: the energy provided to the pellet is lower and thus the velocity of the pellet is lower. This lower energy is not conducive to hunting with such rifles.

Therefore, the consumer is confronted with having to elect between investing in airguns for hunting or airguns for target/competition. That is, it may be difficult for the consumer to justify the extra cost of an additional gun.

Therefore, the need exists for an airgun, such as a PCP airgun, that can provide different pressure motive gas to the projectile as well as provide accommodating sighting.

BRIEF SUMMARY OF THE INVENTION

The present system provides an airgun having a user selected gas pressure exposed to a projectile. The user can expose the projectile to a high pressure source gas or alternatively to a regulated gas pressure. Thus, the airgun, such as the PCP Airgun, can have enhanced performance characteristics corresponding to the intended use—competition/target or hunting.

The disclosure provides an airgun having a regulator selected to receive a high pressure gas from an upstream high pressure reservoir and pass a regulated pressure gas to a downstream firing pressure reservoir; a bypass line fluidly connecting the high pressure reservoir and the firing pressure reservoir; and a valve selectively permitting flow through the bypass line.

A method of operating an airgun is provided which includes selectively bypassing a pressure regulator in an airgun to expose a firing pressure reservoir downstream of the pressure regulator to a high pressure reservoir upstream of the pressure regulator.

A further configuration is disclosed having an airgun with a high pressure reservoir; a firing pressure reservoir; a regulator intermediate the high pressure reservoir and the firing pressure reservoir, the regulator selected to receive a high pressure gas from the high pressure reservoir and pass a regulated pressure gas to the downstream firing pressure reservoir; a bypass line connecting the high pressure reservoir to the low pressure reservoir; and a bypass valve in the bypass line, the bypass valve selectively permitting flow from the high pressure reservoir to the low pressure reservoir.

Also disclosed is an airgun having a high pressure reservoir; a firing pressure reservoir; a valving to selectively expose a projectile in a breech of the airgun to one of a regulated gas pressure and a higher gas pressure; and a reticle having a first set of markings for the projectile exposed to the regulated gas pressure and a second set of markings for the projectile exposed to the higher gas pressure.

A method is also disclosed including providing a high pressure reservoir and a firing pressure reservoir in an airgun; locating a pressure regulator intermediate the high pressure reservoir and the firing pressure reservoir; and providing a bypass line from a high pressure reservoir to the firing reservoir in the airgun.

BRIEF DESCRIPTION OF THE SEVERAL VIEWS OF THE DRAWING(S)

DETAILED DESCRIPTION OF THE INVENTION

Referring to the Figures, the present system provides an airgun 10 for selectively discharging or firing a projectile.

The term "airgun" is understood to encompass any device, from a small handheld weapon to a large piece of artillery that has an elongate tube or barrel through which projectiles, such as bullets or missiles are fired by an expanding motive gas. Thus, the term "gun" includes pistols, rifles or shotguns.

For purposes of description, in an exemplary configuration, the airgun is generally referred to in the art as a pre-charged pneumatic (PCP). As used herein, the term "motive gas" or "gas" means any compressed gas including gas mixtures, which can be used to expel the projectile from the barrel, such that motive gas does not include gas resulting from combustion. Thus, motive gas includes but is not limited to compressed (at a pressure greater than ambient pressure) air, nitrogen, $CO_2$, helium or any other gas or mixture thereof.

Figure 1:
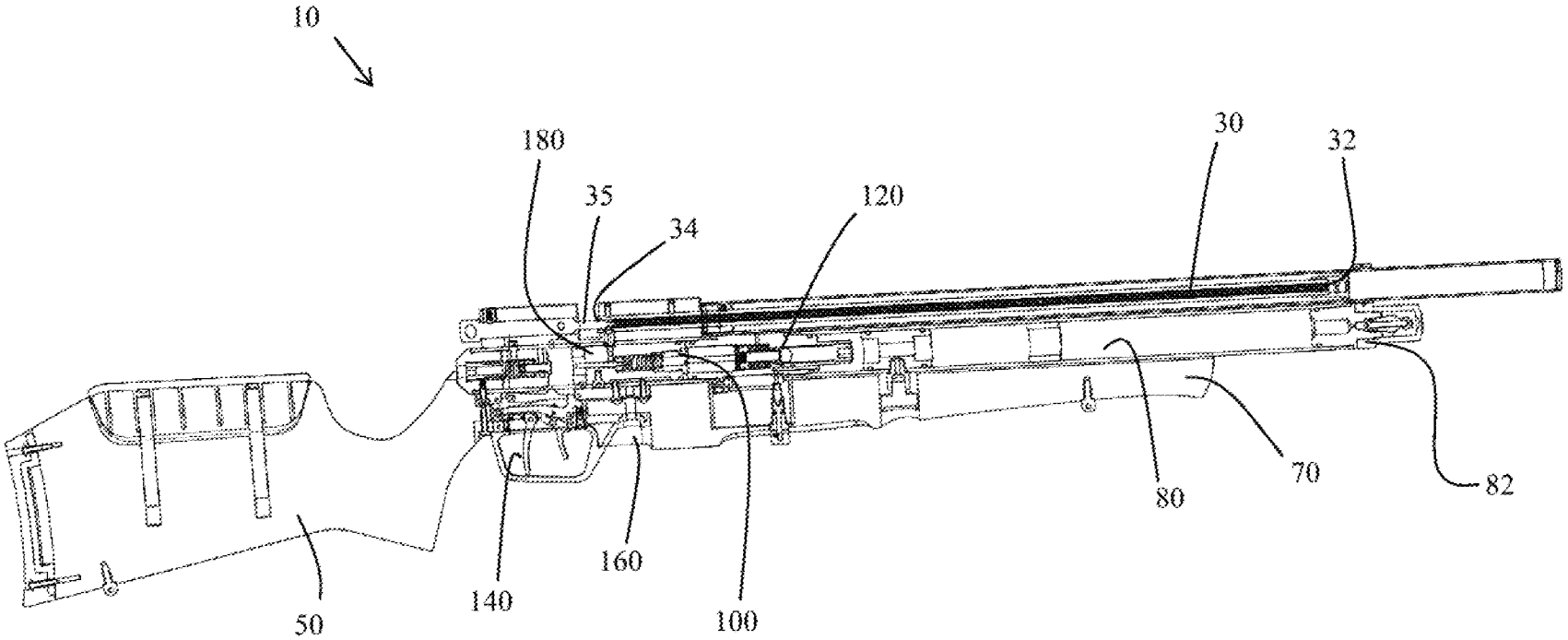
FIG. 1 is a side elevational perspective cross sectional view of an airgun incorporating the present system.

As seen in FIG. 1, the airgun 10 includes a barrel 30, a stock 50 and a fore end 70 as well known in the art.

Referring to the Figures, the airgun 10 includes a high pressure reservoir 80, a firing pressure reservoir 100 and a regulator 120 fluidly connecting the high pressure reservoir and the firing pressure reservoir. The airgun 10 further includes a trigger assembly 140, a receiver 160, a firing valve assembly 180 as known in the art.

The receiver 160 operably connects the barrel 30, the trigger assembly 140, the fore end 70, and the stock 50. The receiver 160 can be a multi-component element. However, it is understood the receiver 160 can be formed of greater or fewer number of components.

The barrel 30 has a longitudinal axis and terminates at a front end or muzzle 32 and at a rear end 34. For purposes of description, the term forward or front is used in the description as the direction towards the muzzle 32, and the term rear or rearward means the direction towards the opposing or rear end 34 of the barrel 30.

The rear end 34 of the barrel 30 defines a portion of a breech 35. For purposes of the present description, the breech 35 is the space which houses the projectile when the projectile is rapidly exposed to the firing pressure reservoir 100 to be propelled through the barrel 30. Depending upon the intended usage of the airgun 10, the barrel 30 can include rifling, however it is not required that the barrel be rifled.

A clip or magazine can be operably engaged with the receiver 160 to present a projectile to the breech 35. It is understood the system is not limited to a particular clip or magazine and can be operable with a single round loading of the airgun 10. Further, the system is not limited by the particular configuration of the breech 35.

Figure 2:
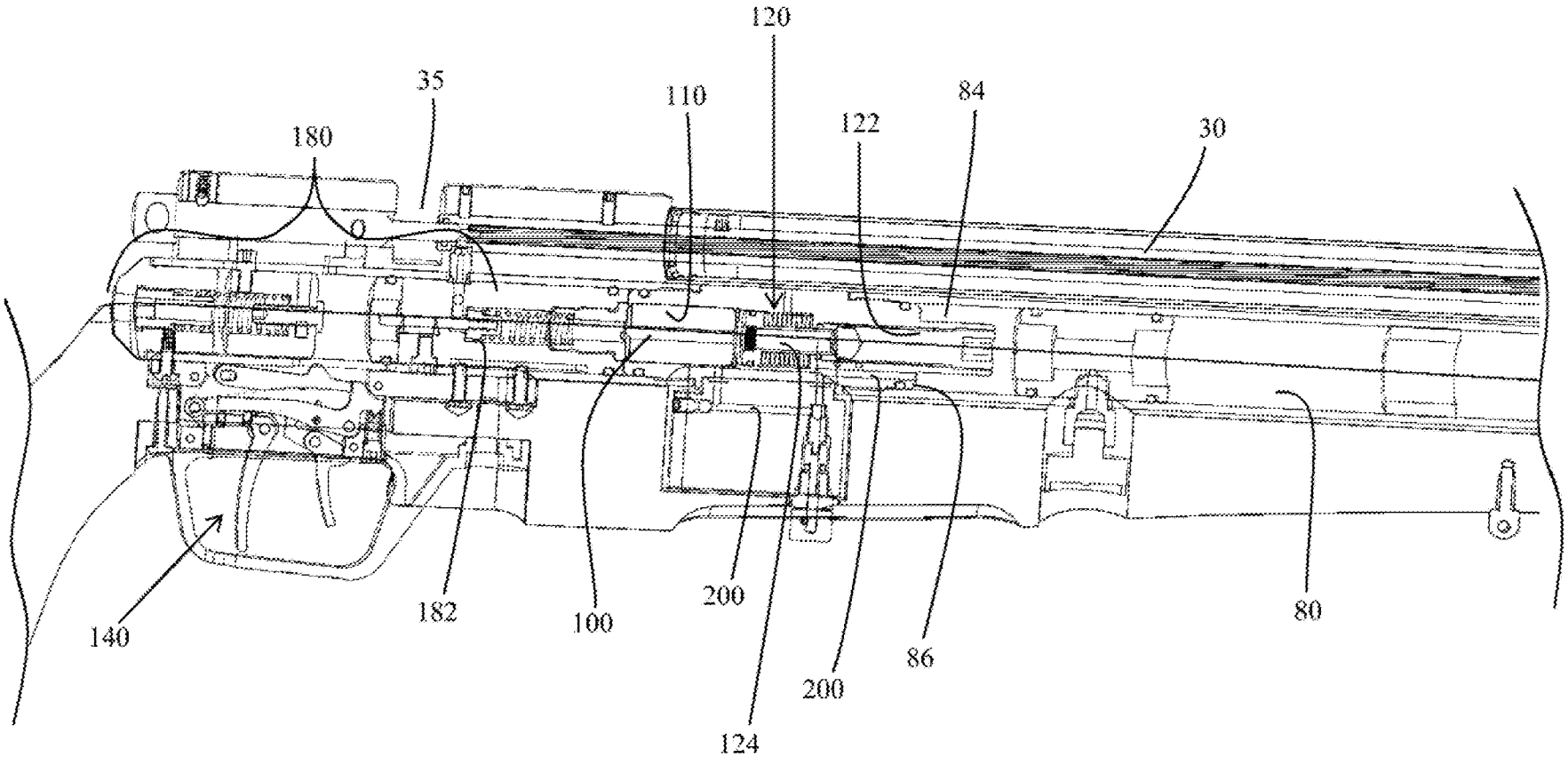
FIG. 2 is a line rendering of a portion of the airgun of FIG. 1, with fragment lines bounding the illustrated portion of the airgun.
Figure 3:
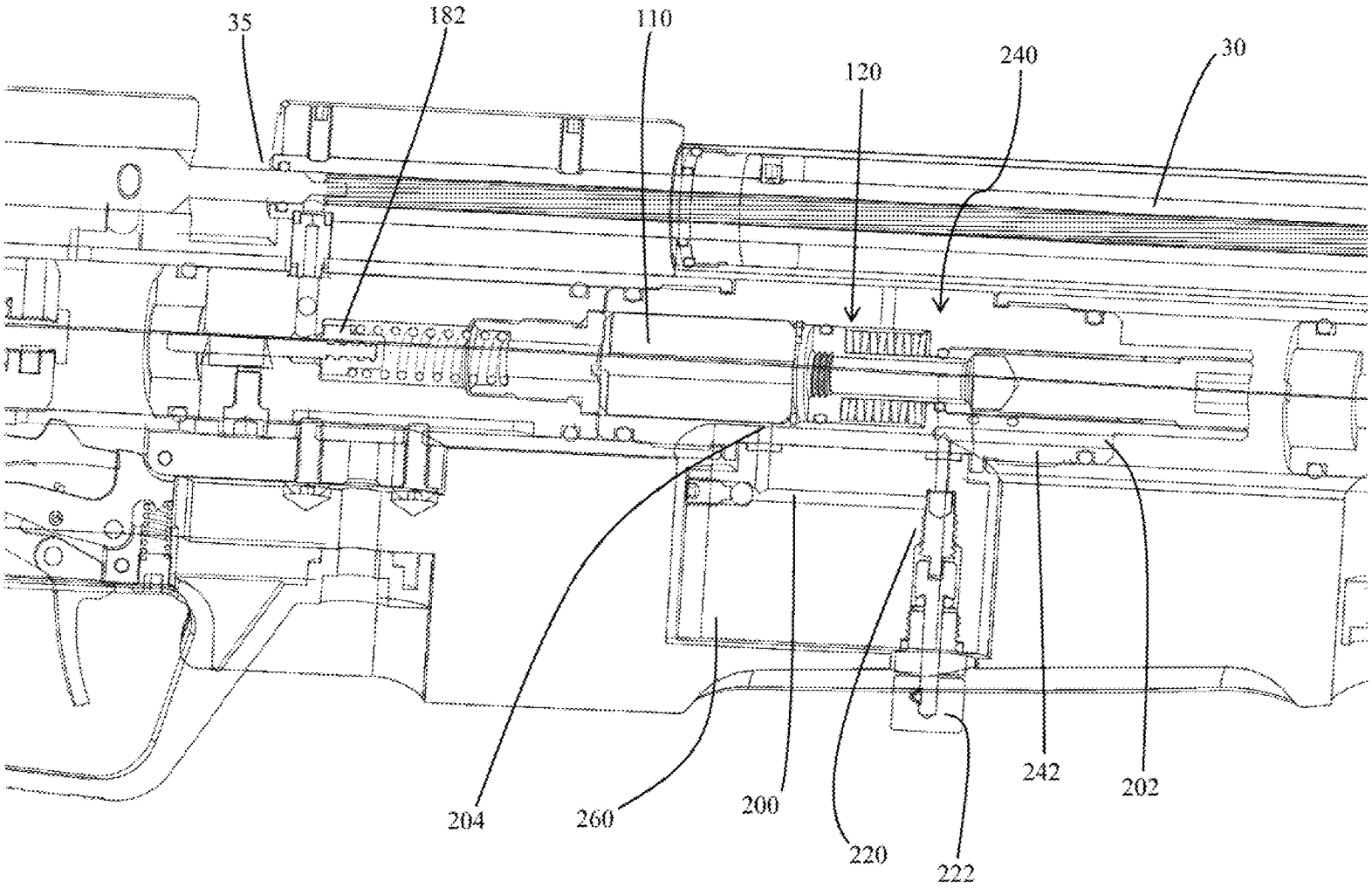
FIG. 3 is a side elevational perspective cross sectional view of a portion of the airgun of FIG. 2.
Figure 4:
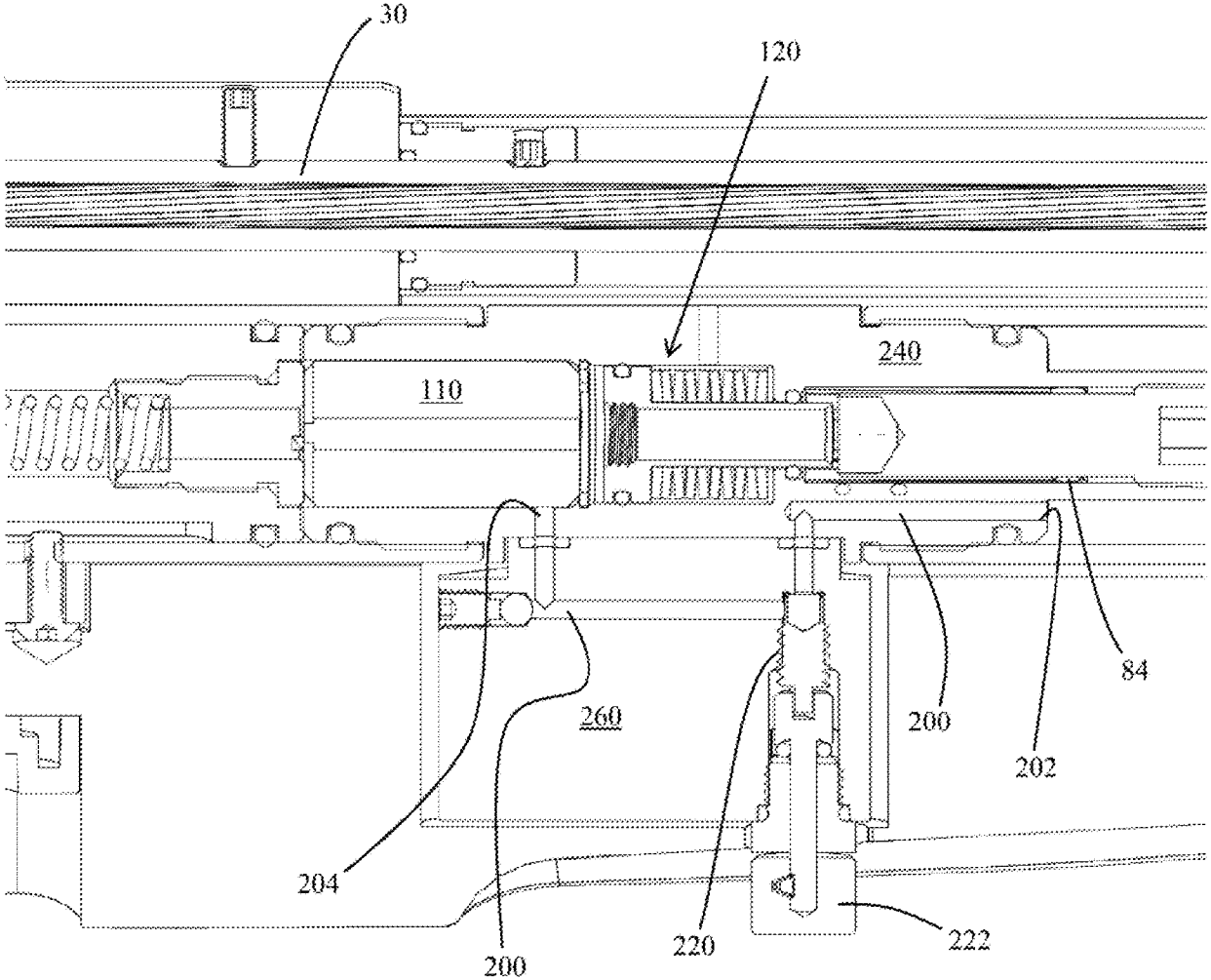
FIG. 4 is a side elevational perspective cross sectional view of a portion of the airgun of FIG. 4.
Figure 5:
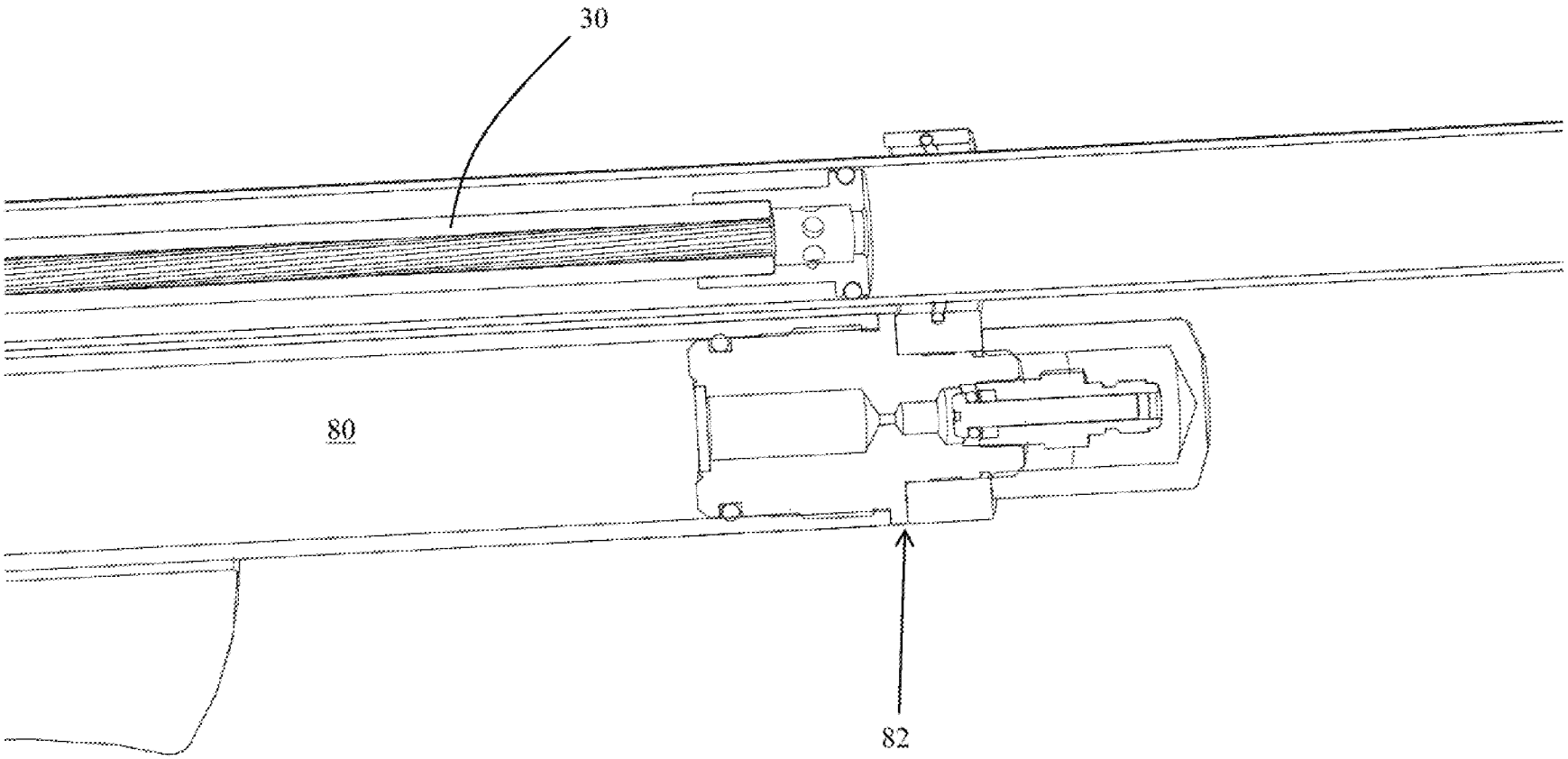
FIG. 5 is an enlarged side elevational perspective cross sectional view of a portion of an airgun of FIG. 1.

Referring to FIGS. 2-4, the firing valve assembly 180 includes a firing valve 182 located intermediate the firing pressure reservoir 100 and the breech 35. The firing valve 182 selectively exposes the breech 35 to the firing pressure reservoir 100. The trigger assembly 140 is operably connected to the firing valve 182 for selectively moving the firing valve 182 from a closed position to an open position.

The airgun 10 also includes a bypass line 200 fluidly connecting the high pressure reservoir 80 and the firing pressure reservoir 100, wherein a bypass valve 220 can be operably located in the bypass line.

The high pressure reservoir 80 is configured to retain a volume (or mass) of pressurized gas, such as air. The high pressure reservoir 80 includes an inlet 82 configured to operably connect to a high-pressure gas source as known in the art.

The high pressure reservoir 80 can acquire the high pressure motive gas through any of a variety of configurations, including but not limited to selective and periodic fluid connection to a separate tank; from a single or multiple stage pump integrally connected to the airgun 10 or removably connected through a valve as known in the art. Alternatively, the high pressure reservoir 80 can be charged from single use cartridges of compressed gas.

The high pressure reservoir 80 supplies pressurized air to a first outlet port 84 to the regulator 120 and a second port 86 to the bypass line 200. The first port 84 presents motive gas, at the pressure of the high pressure reservoir 80, to the regulator 120. The second outlet port 86 presents motive gas, at the pressure of the high pressure reservoir 80, to the bypass line 200.

In one configuration, the high pressure reservoir 80 is constructed to operate at pressures above 2,000 psi, and in certain configurations pressures above 4,000 psi to as much as 8,000 to 12,000 psi (as is known in the art). It is understood, the upper operating pressure of the high pressure reservoir 80 is not limiting to the present system. In one configuration, the high pressure reservoir 80 defines a sufficient volume to provide for a plurality of firings of the airgun 10 with a motive gas pressure that is either regulated or at the pressure of the high pressure reservoir.

The regulator 120 has an inlet 122 to receive the motive gas from the high pressure reservoir 80 through the second port 86. The regulator 120 drops the pressure of the motive gas from the pressure of the high pressure reservoir 80 to a regulated gas pressure in the firing pressure reservoir 100. In one configuration, the regulated gas pressure is approximately 225 psi.

The regulator 120 can be a single or multi-stage regulator. In a two-stage regulator the regulator drops the motive gas from the pressure of the high pressure reservoir 80 to approximately 700 psi to 800 psi in the first stage and then drops the pressure to a firing pressure at the regulated pressure of approximately 225 psi in the firing pressure reservoir 100. It is understood these pressures are not limiting to the present system, but are rather illustrative. The regulator 120 can be any commercially available single or multi-stage regulator.

The regulator 120 has an outlet 124 for establishing the motive gas at the regulated pressure in the firing pressure reservoir 100. The firing pressure reservoir 100 is selectively fluidly connected to the breech 35 through actuation of the trigger assembly 140 and the firing valve 182 as known in the art.

In one configuration, the regulator 120 is operably retained within an adapter 240. The adapter 240 includes a body 242 which in cooperation with seals, such as O-rings as known in the art, forms a sealed interface relative to the high pressure reservoir 80 and the firing pressure reservoir 100.

As set forth above, bypass line 200 fluidly connects the high pressure reservoir 80 and the firing pressure reservoir 100 without passing through the regulator 120. The bypass line 200 can include a bypass valve 220 that can be operably located in the bypass line. The bypass valve 220 is any of a variety of commercially available valves for high pressure gas.

In one configuration, an upstream end 202 of the bypass line 200 is defined by the adapter 240 and the portion of the bypass line in the adapter extends to a bypass block 260. Thus, a portion of the bypass line 200 can be formed in the adapter 240.

The bypass block 260 defines the bypass line 200 to a downstream end 204 at the firing pressure reservoir 100. While the bypass line 200 can be formed by or through any of a variety of components of the airgun 10, it is believed advantageous for manufacturing purposes to form the portion of the bypass line in the bypass block 260 as shown in the figures. For example, the bypass line 200 can be readily formed by drilling the bypass block 260 with intersecting bores, then plugging or capping one of the bores to form the desired configuration of the bypass line in the bypass block.

In one configuration, the bypass valve 220 is retained in the bypass block 260 to interface with the bypass line and selectively permit or preclude passage through the bypass line 200.

When the bypass valve 220 is closed, the pressure of the gas in the high pressure reservoir 80 acts on the bypass valve 220 and the regulator 120, and the gas cannot pass through the bypass line 200. The regulator 120 allows passage of a generally predetermined pressure of gas to pass from the high pressure reservoir 80 to the firing pressure reservoir 100.

Thus, upon firing the airgun 10 in this configuration (with the bypass valve 220 closed), the projectile in the breech 35 is exposed to the regulated gas pressure of the firing pressure reservoir 100. The motive gas then acts upon the projectile in the breech 35 and causes the projectile to pass through and out the barrel 30. That is, the motive gas at the regulated gas pressure in the firing pressure reservoir 100 discharges the projectile from the breech 35 and through the barrel 30 to exit the muzzle 32.

When the bypass valve 220 is opened, any motive gas of a higher pressure than the regulated gas from the regulator 120 will flow through the bypass line 200 and through the bypass valve to the firing pressure reservoir 100. Thus, upon firing the airgun 10 in this configuration (with the bypass valve 220 open), the projectile in the breech 35 is exposed to the pressure of the motive gas in the high pressure reservoir 80. The motive gas then acts upon the projectile in the breech 35 and causes the projectile to pass through and out the barrel 30. That is, the motive gas discharges the projectile from the breech 35, through the barrel 30 to exit the muzzle 32.

In one configuration, the firing pressure reservoir 100 is sized to retain a sufficient volume of gas at the pressure of the high pressure reservoir 80 to provide a single firing of the airgun 10 and thus single launch of a single projectile from the airgun. Thus, upon bypassing the regulator 120, the user fills the firing pressure reservoir 100, which is sized to retain a sufficient mass of gas to provide for a single firing at the pressure of the high pressure reservoir.

Figure 6:
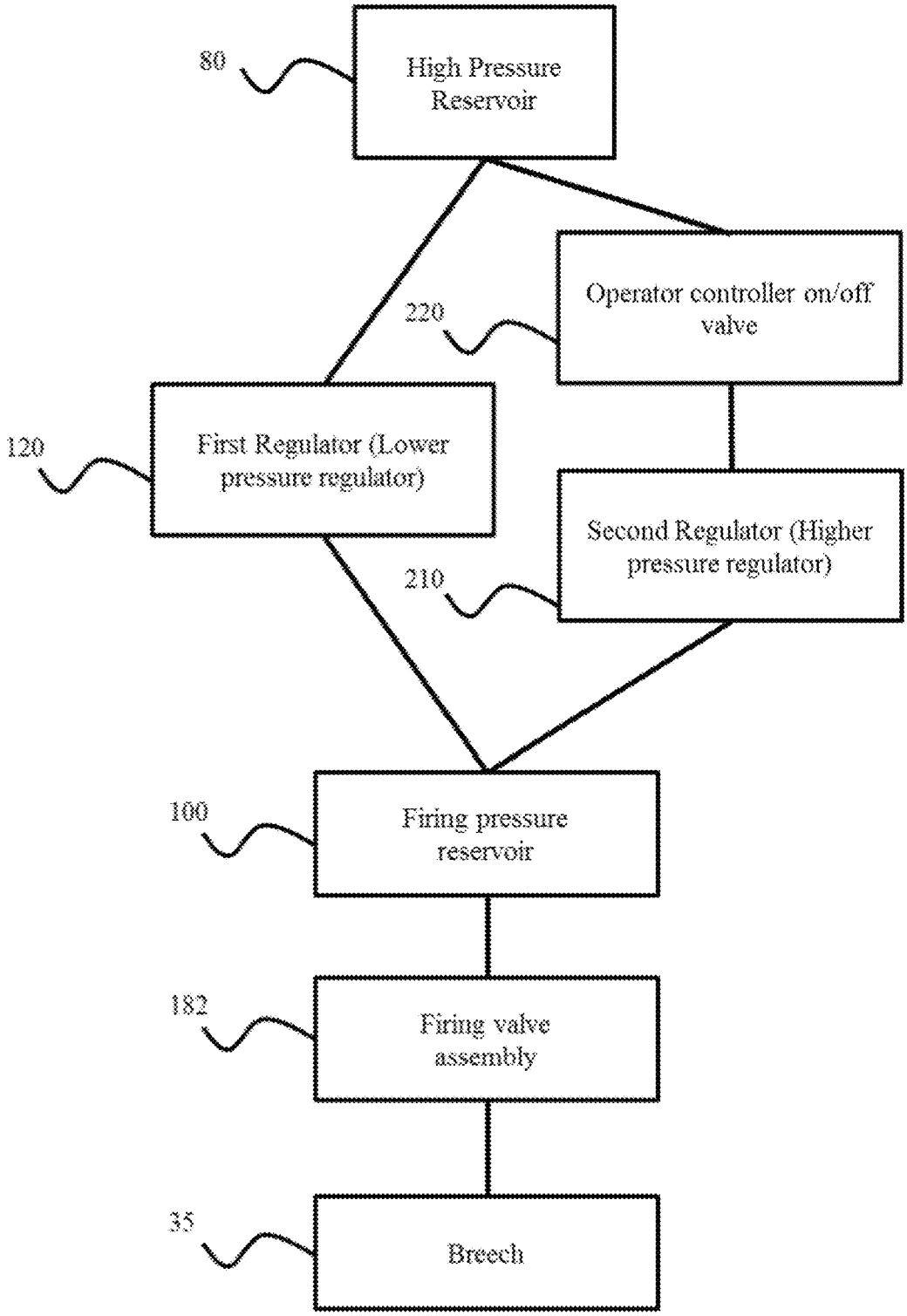
FIG. 6 is a schematic representation of an alternative configuration of an airgun incorporating the present system.

Although the configurations have been set forth in terms of a regulated pressure and an unregulated pressure (that of the high pressure reservoir 80), it is contemplated a first regulator 120 and the second regulator 210 can be employed, wherein the corresponding regulated pressures are different—effectively providing a relative high pressure firing and a relative low pressure firing. In this configuration, schematically shown in FIG. 6, the airgun 10 includes a second regulator, such as located in the bypass line 200, wherein the second regulator 210 has a higher regulated pressure than the first regulator 120. The bypass valve 220 then selectively exposes the second regulator 210 to the pressure in the high pressure reservoir 80.

As the airgun 10 selectively exposes the projectile to either a regulated pressure or a high pressure motive gas, the projectile will have materially different trajectories. Thus, a sighting in of the airgun 10 for the regulated pressure will not be useful in aiming the airgun for projectiles fired at the pressure of the high pressure reservoir. Similarly, a sighting in of the airgun 10 for the pressure of the high pressure reservoir will not be useful in aiming the airgun for projectiles fired at the regulated pressure.

Figure 7:
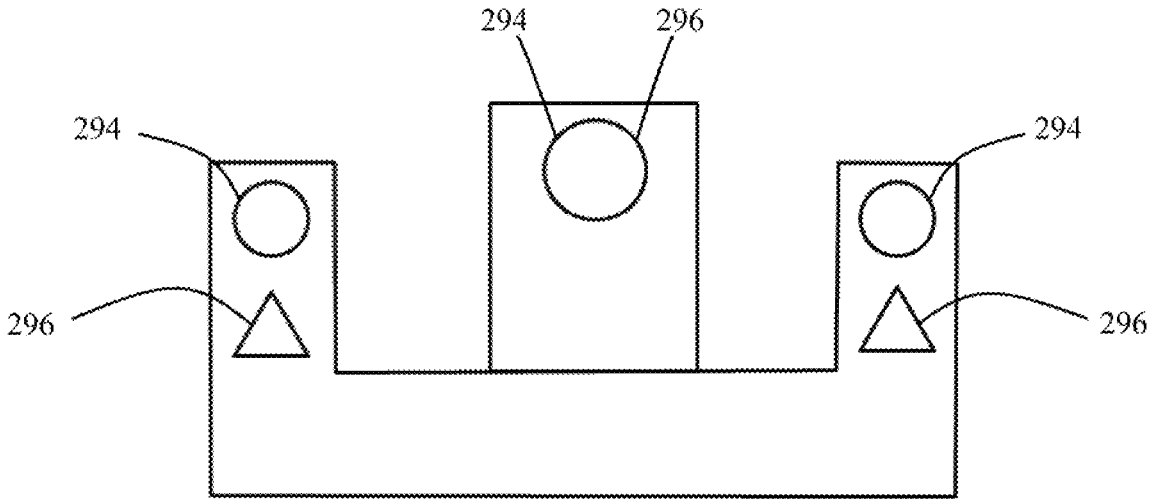
FIG. 7 is a schematic representation of a first configuration of sighting elements in the present system.
Figure 8:
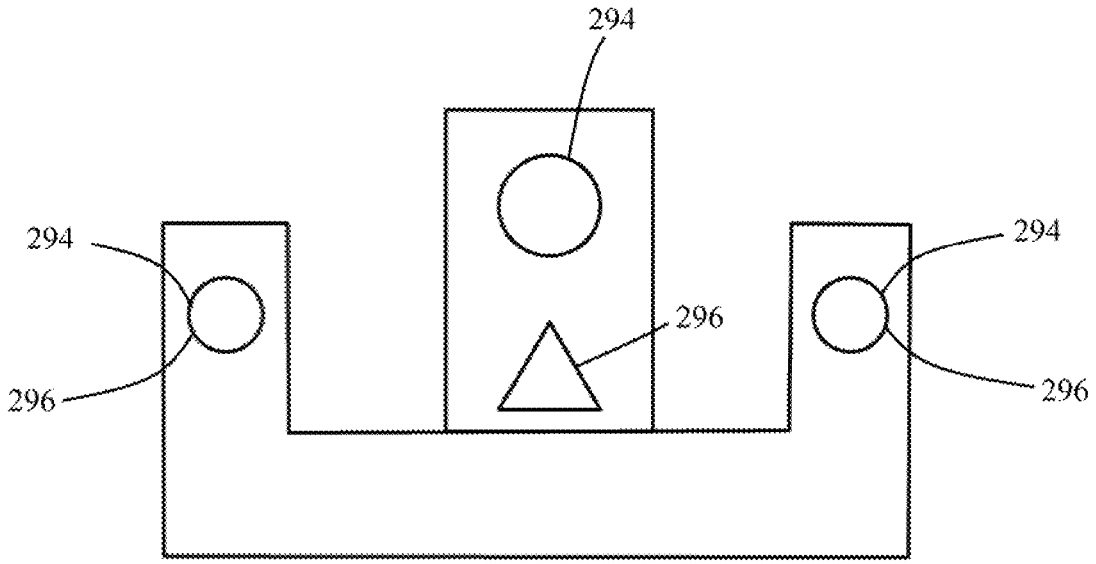
FIG. 8 is a schematic representation of a second configuration of sighting elements in the present system.

Therefore, referring to FIGS. 7 and 8, the airgun 10 includes a first set of sighting elements 294 for projectiles fired at a first pressure, such as the regulated pressure, and a second set of sighting elements 296 for projectiles fired at a second pressure, such as at the pressure of the high pressure reservoir. The sighting elements can be fixed front and rear sights or adjustable front and/or rear sights to provide the two sets. Further, the sighting elements 294, 296 can be different gratings or markings of a reticle. Thus, the reticle can include a first set of markings for firings at the regulated pressure and a second set of markings for firings at the pressure of the high pressure reservoir.

Thus, the airgun 10 can include the high pressure reservoir 80; the firing pressure reservoir 100; the valving 180 to selectively expose a projectile in the breech 35 of the airgun 10 to one of a regulated gas pressure and a higher gas pressure; and the reticle having a first set of markings 294 for aiming the airgun for the projectile exposed to the regulated gas pressure and a second set of markings 296 for aiming the airgun for the projectile exposed to the higher gas pressure.

The invention has been described in detail with particular reference to a presently preferred embodiment, but it will be understood that variations and modifications can be effected within the spirit and scope of the invention. The presently disclosed embodiments are therefore considered in all respects to be illustrative and not restrictive. The scope of the invention is indicated by the appended claims, and all changes that come within the meaning and range of equivalents thereof are intended to be embraced therein.

The invention claimed is:

1. An airgun comprising:

(a) a first regulator selected to receive a high pressure gas from an upstream high pressure reservoir and pass a first regulated pressure gas to a downstream firing pressure reservoir;

(b) a bypass line fluidly connecting the high pressure reservoir and the firing pressure reservoir; and (c) a second regulator in the bypass line, the second regulator selected to receive a high pressure gas from the upstream high pressure reservoir and pass a second regulated pressure gas to the downstream firing pressure reservoir.

2. The airgun of claim 1, wherein the first regulator is a single stage regulator.

3. The airgun of claim 1, wherein the second regulated pressure gas is a greater pressure than the first regulated pressure gas.

4. The airgun of claim 1, wherein a pressure of the second regulated pressure gas is different than a pressure of the first regulated pressure gas.

5. The airgun of claim 1, further comprising a bypass valve selectively permitting flow of high pressure gas from the upstream high pressure reservoir to the bypass line.

6. The airgun of claim 1, further comprising a bypass selector configured to selectively fluidly connect the high pressure reservoir to one of the first regulator and the bypass line.

7. The airgun of claim 1, further comprising a breech downstream of the firing pressure reservoir.

8. The airgun of claim 1, wherein a volume of the firing pressure reservoir is sized to provide only a single firing of the airgun from flow passed through the bypass line.

9. The airgun of claim 1, wherein a volume of the firing pressure reservoir is sized to provide less than three firings of the airgun from flow passed through the bypass line.

10. The airgun of claim 1, further comprising an adapter operably retaining the first regulator.

11. The airgun of claim 10, wherein a portion of the bypass line is formed in the adapter.

* * * * *